US006772580B2

(12) United States Patent
Seliktar

(10) Patent No.: US 6,772,580 B2
(45) Date of Patent: Aug. 10, 2004

(54) DECORATIVE, DIAMOND-CUT JEWELRY SURFACE

(75) Inventor: Ronen Seliktar, Long Island City, NY (US)

(73) Assignee: Select Jewelry Inc., Long Island City, NY (US)

( * ) Notice: Subject to any disclaimer, the term of this patent is extended or adjusted under 35 U.S.C. 154(b) by 120 days.

(21) Appl. No.: 10/156,609

(22) Filed: May 24, 2002

(65) Prior Publication Data

US 2003/0177788 A1 Sep. 25, 2003

Related U.S. Application Data

(63) Continuation-in-part of application No. 10/104,141, filed on Mar. 21, 2002.

(51) Int. Cl.[7] ..... B21L 17/00; A44C 27/00

(52) U.S. Cl. ..... 59/80; 59/35.1; D11/91; 29/896.41; 63/4; 63/11; 63/28

(58) Field of Search ..... D11/91; 63/26, 63/28, 32, 3, 4, 11; 29/896.41; 59/80, 82, 35.1

(56) References Cited

U.S. PATENT DOCUMENTS

| | | | | |
|---|---|---|---|---|
| 233,422 A | | 10/1880 | Mason | |
| 964,624 A | | 7/1910 | Doran | |
| 1,734,625 A | | 11/1929 | Heyman | |
| 1,941,684 A | | 1/1934 | Hiller | |
| 2,261,958 A | | 11/1941 | Burri | |
| 2,887,746 A | | 5/1959 | Bogoff | |
| 5,581,992 A | * | 12/1996 | Borouchov | 59/29 |
| 6,389,790 B1 | * | 5/2002 | Rosenwasser et al. | 59/80 |
| 6,484,488 B2 | * | 11/2002 | Rosenwasser et al. | 59/35.1 |

* cited by examiner

*Primary Examiner*—David Jones
(74) *Attorney, Agent, or Firm*—Ostrolenk, Faber, Gerb & Soffen, LLP

(57) ABSTRACT

Jewelry pieces, for example, earrings, pendants, rings and the like, made of metal such as gold or silver and the like, with special surface texturing to improve and enhance the light-reflecting characteristics of the jewelry. The surface texturing is formed by forming a series of grooves by the process of diamond-cutting the surface of the jewelry piece to divide the surface thereof into a plurality of adjacent, four-sided regions, each of which is bounded by four diamond-cut grooves and defines a mesa with at least four light-reflecting sloping sides. The mesas are further subdivided by forming a pair of diamond-cut grooves that criss-cross one another, thereby dividing the mesas in the four-sided regions into four sub-mesas, each having at least three sloping light reflecting sides. Preferably, first gemstones are set at the junctures of the four-sided mesas and second gemstones are set at the center, where the four sub-mesas meet.

22 Claims, 3 Drawing Sheets

DECORATIVE, DIAMOND-CUT JEWELRY SURFACE

This is a continuation-in-part application of application Ser. No. 10/104,141 entitled Decorative, Diamond-Cut Jewelry Surface, which was filed on Mar. 21, 2002.

BACKGROUND OF THE INVENTION

The present invention relates generally to the making of jewelry, and more particularly to a method of texturing the jewelry surface using the technique of diamond cutting to create a surface texture of greater brilliance, beauty and light reflecting characteristics. The invention further relates to the jewelry obtained by the method of the present invention.

The jewelry business is very competitive. Jewelry designers and manufacturers constantly strive to evolve new and more interesting jewelry designs and are investing a great deal of resources, both monetary and in the form of human resources, in attempts to innovate new designs, new styles, and new, exciting looks in jewelry.

One of the very old and widely used techniques in the creating of textured surfaces on jewelry made from metals, particularly gold, silver and the like, is known as diamond-cutting. The technique of diamond-cutting involves the use of a very sharp, knife-like instrument which is used to cut into and texture the surface of the metallic surface of the jewelry. Essentially, the purpose of diamond-cutting is to create micro facets in the gold or silver surface which then reflects light in all directions, creating a brilliance, sparkle, and light kaleidoscope that enhances the beauty of the jewelry.

There is a constant need and desire to build on the old technology, to evolve a more brilliant, more sparkling and more beautiful surface texturing on jewelry.

BACKGROUND OF THE INVENTION

Accordingly, it is an object of the present invention to provide a more elaborate, more sparkling and more light-reflective surface for jewelry.

It is a further object of the invention to provide a novel surface texturing for jewelry that can be inexpensively and simply produced.

Yet another object of the invention is to produce a more sparkling and a more light-reflective surface using the diamond-cutting technique.

It is a further object of the invention to decorate a diamond-cut surface which creates greater light reflectivity with a new arrangement of decorative gemstones, which can be precious, semi-precious or man-made gemstones.

The foregoing and other objects of the invention are realized by the adaptation and improvement of the known diamond-cutting technique to create a pattern of repeating, square-shaped plateaus or mesas on the surface of the jewelry piece, by further engraving X-shaped criss-crossing cuts in each of the known squares of the prior art system, thereby to create within each square, four pyramid or mesa-shaped structures, each having three sloping surfaces which reflect the light, so as to increase the number of light-reflecting surfaces approximately threefold, to thereby multiply and enhance the brilliance, and light-reflecting characteristics of the jewelry surface.

The center of the X-shaped cuts form a well in which gemstones can be set, typically semi-precious and in accordance with the preferred embodiment of the present invention, man-made gemstones, for example, those made of enamel, colored or transparent. Another array of such gemstones is provided at the corners of the basic repeating square pattern and these stones are similarly made of gemstones, man-made, semi-precious, or of any type.

The gemstones at the corners of the square-shaped repeating patterns and at the centers of the X-shaped cuts can be of the same color or of different colors, as well as of different characteristics, namely real, man-made, semi-precious or any type of gemstone known or which may become available to the art.

In accordance with the further feature of the invention, the brilliantly sparkling diamond-cut surface is obtained by incorporating the x-shaped cuts without having those x-shaped cuts being surrounded or placed within the known square or triangle, prior art diamond-cut shapes.

The surface texturing methodology of the present invention is applicable to the surfaces of any type of jewelry, including pendants, rings, earrings, or indeed, any piece of jewelry that is made of metal which, when diamond-cut, creates a sparkling effect.

Other features and advantages of the present invention will become apparent from the following description of the invention which refers to the accompanying drawings.

DETAILED DESCRIPTION OF PREFERRED EMBODIMENTS

Figure 1:
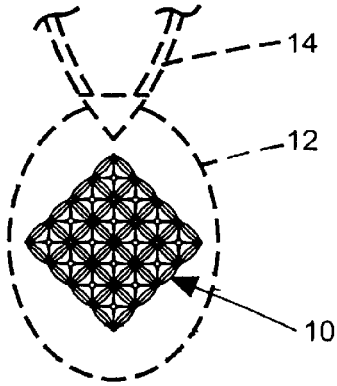
FIG. 1 shows a generic jewelry piece which has a surface that is textured in accordance with the method of the present invention.

FIG. 1 shows in dotted line, a generic piece of jewelry 12, which can be a pendant hung by a chain 14, on which the novel surface texture design 10 of the present invention is formed to cover a portion or the entirety of its surface.

The periphery of the design does not need to be square-shaped, as shown in FIG. 1 (or in FIG. 2) and the design can be formed in any jewelry surface, whether that surface is flat or curved, as in a ring or earring, or whether the surface curves in three dimensions as on a ball-shaped jewelry piece.

Figure 2:
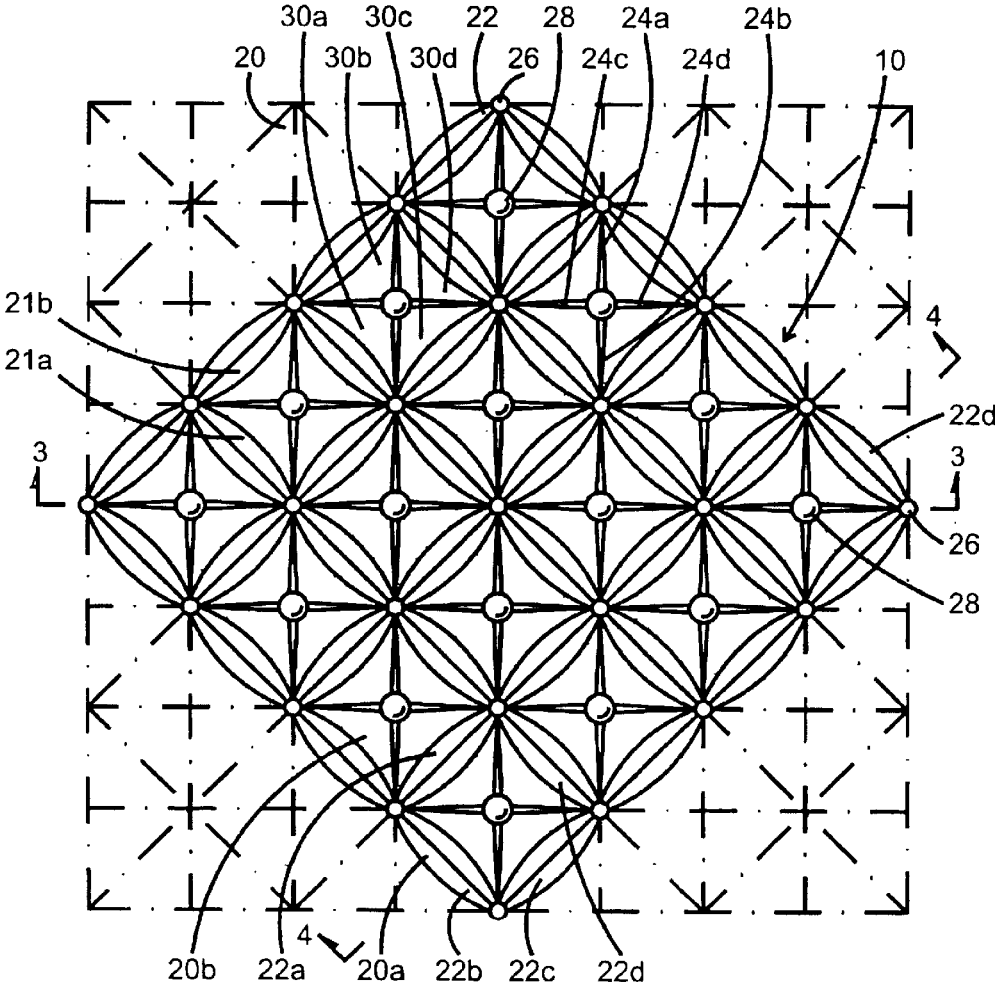
FIG. 2 is an enlargement showing the details of the surface texture of FIG. 1.

The method of creating the diamond-cut surface design of the present invention is explicated in greater detail by reference to FIG. 2. The surface pattern of the present invention is substantially in the form of repeating squares or rectangles 20, each of which is defined by diamond-cut grooves 22 formed on the four sides thereof. More specifically, each square is defined by diamond-cut grooves 22*a*, 22*b*, 22*c* and 22*d*. Except for squares or partial squares which are near the outer periphery of the overall design, each of these grooves is shared by adjoining squares. For example, the diamond-cut groove 22*d* is shared by the adjoining squares 20*a* and 20*b*. After a particular square 20 has been defined, there is formed a mesa or a plateau that is surrounded by four grooves.

Since the grooves may be formed with a generally triangular-shaped cutting knife, the mesas have a series of inclined surfaces 21*a*, 21*b* which extend at an angle to the flat surface of the jewelry (the surface of the paper in FIG. 2), causing light to reflect in different directions at the four sides of each mesa. When these diamond-cut grooves are made by machine or by hand, the depth of the groove increases toward the center of each groove segment. The corners where each of these grooves 22*a*, 22*b*, 22*c* and 22*d* meet defines a high point where a precious gemstone 26 can be mounted. As noted, the gemstones can be real diamonds, which are glued in place, or man-made diamond such as those made of enamel and similar man-made materials, in a manner well-known in the art.

The present invention departs from the prior art by incorporating a further set of grooves in the surface, essentially by engraving an X-shaped pair of grooves, using the same diamond-cutting technique. The two diamond-cut grooves extend from corner to corner across the mesas. Thus, for example, one groove extends from the juncture of the grooves 22*a* and 22*d* to the juncture of the grooves 22*b* and 22*c*. Similarly, the second diamond-cut groove extends from the juncture of the grooves 22*a* and 22*b* to the juncture of the grooves 22*c* and 22*d*. The same pattern of X-shaped diamond-cut grooves is made in all or in substantially most of the grooves, thereby subdividing each of the repeating square-shaped mesas into four pyramid-like (or mesa-like) structures each with three sides that slope at an angle into the thickness of the material of the jewelry.

More specifically, in FIG. 2, four such pyramids 30*a*, 30*b*, 30*c* and 30*d* are shown. Each has a flat top and three down-trending slopes. It is not necessary for the top of the pyramid to be flat, as it may be pointed when the diamond-cut grooves are formed wider or deeper into the material, so that the top of the pyramid begins to slope almost immediately, increasing the light reflectivity and kaleidoscope of light and color that the surface radiates.

Due to the intersection of the pair of X-shaped grooves, there is created a well at the center of each square-shaped mesa, where a further gemstone 28 is set. As before, this gemstone 28 can be real or man-made or semi-precious. It can be of any color or transparent or of any shape, for example, round or triangular, as to satisfy the imagination of the particular customer or jewelry designer.

The sizes of the gemstones 26 and 28 can be selected so that the gemstone 28 are larger or smaller or equal in size to the gemstone 26. As noted, the colors and characteristics can be the same or different from one another.

Thus, the additional diamond-cut engraving in accordance with the present invention increases the reflecting surfaces by two or three times, which creates a kaleidoscope of light and color which—due to the use of colored gemstones—enhances the overall beauty and appealing aspect of the surface texture that is formed by the method of the present invention.

Figure 3:
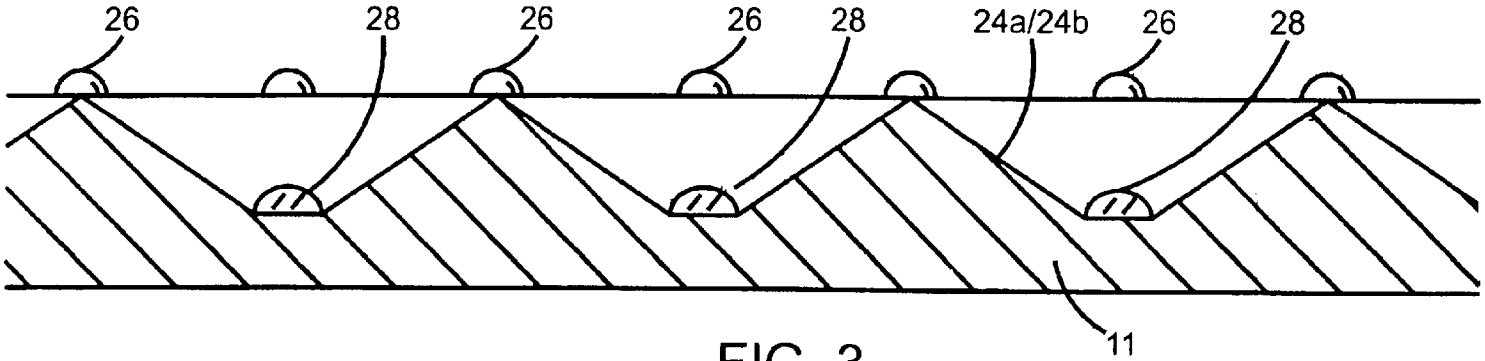
FIG. 3 is a cross-section through lines 3—3 of FIG. 2.

With reference to FIG. 3, which is a cross-section of FIG. 2 through lines 3—3, the gemstone 26 is seen located or deposited at the juncture of the grooves 22*a*/22*d* and the gemstone 28 at the juncture of the groove segments 24*a*, 24*b*, 24*c* and 24*d*.

Figure 4:
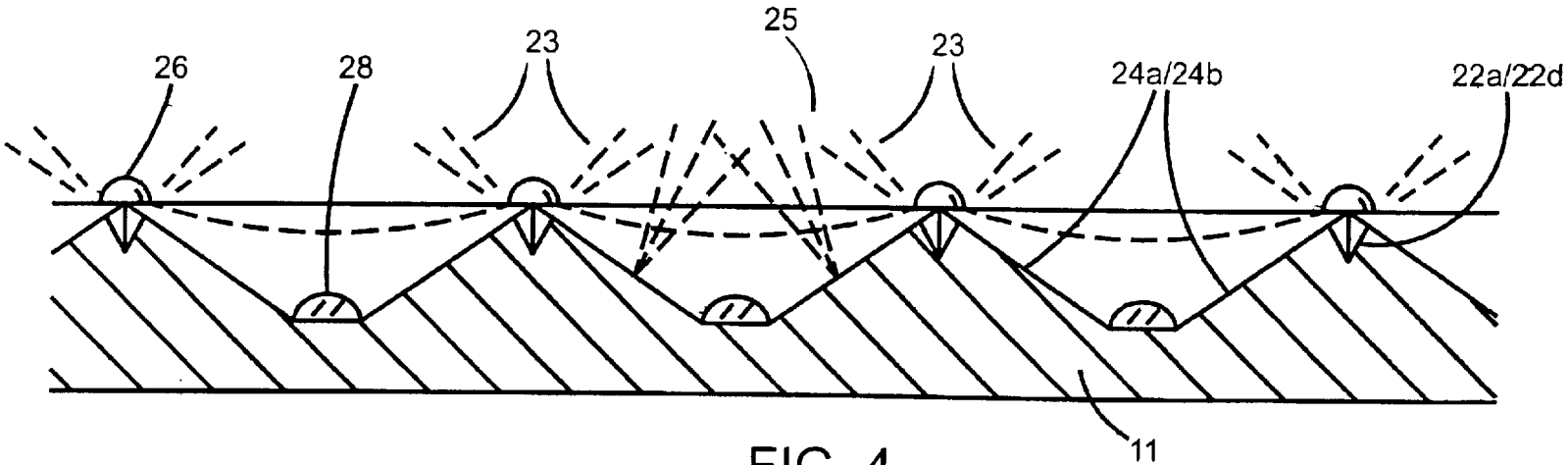
FIG. 4 is a cross-section through lines 4—4 of FIG. 2.

In the cross-sectional view of FIG. 4 which is along lines 4—4 in FIG. 2, the view cuts through the center of the groove 22*d*, and through the gemstone 28. The various reflecting surfaces are more clearly revealed and the view shows light rays 23 and 25 reflected from the various diamond cut surfaces that are made in the precious stone.

It bears repeating that the surface texture created by the diamond-cutting methodology and gemstone decoration of the present invention, can be applied to any jewelry surface made of a material 11 (FIG. 3) in which the diamond-cutting is made and that such jewelry can be of any surface shape, e.g., flat, curving in two or three-dimensions, as long as the material is thick enough to effect therein the diamond-cutting process. The surface texture can reach and cover the entire surface or only portions thereof, all in accordance with the sensibilities and design preferences of individual customers or jewelry designers and the like.

Figure 5:
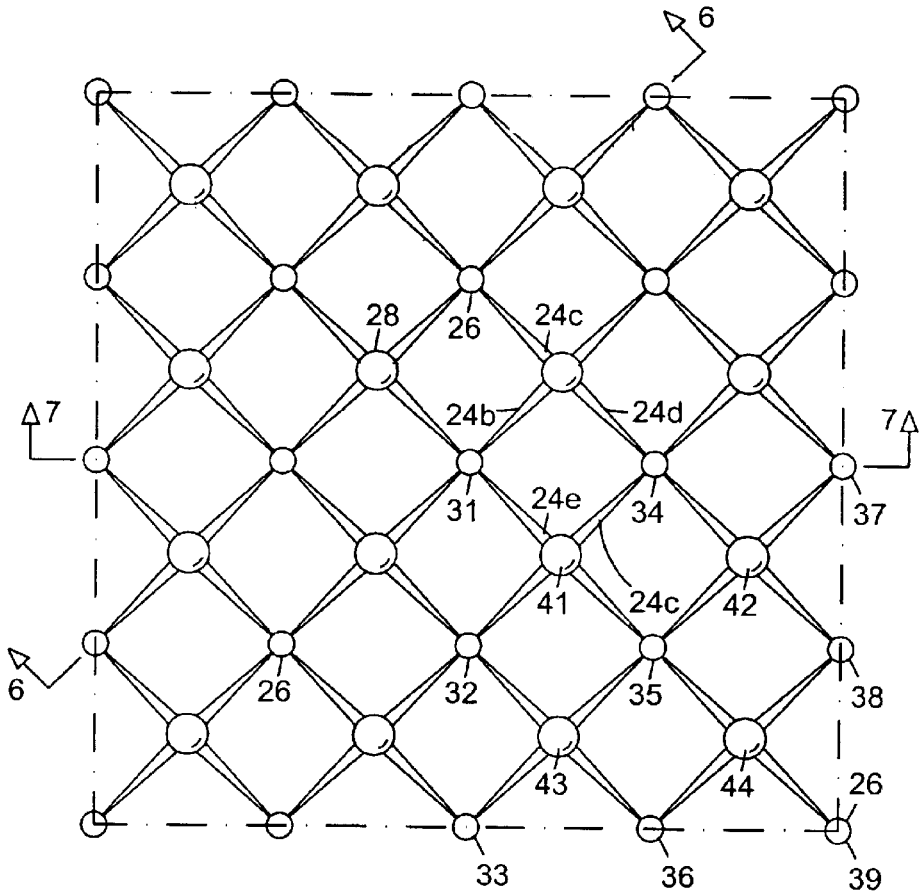
FIG. 5 is a modification of FIG. 2 showing the x-shaped diamond-cuts that are not placed in surrounding square shapes.
Figure 6:
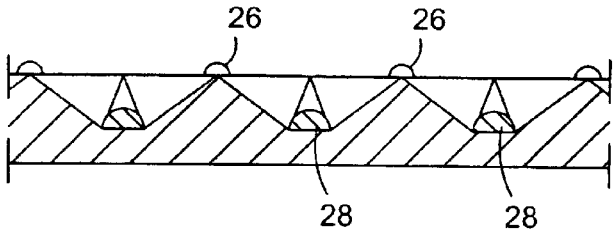
FIG. 6 is a cross-section along lines 6—6 in FIG. 5.
Figure 7:
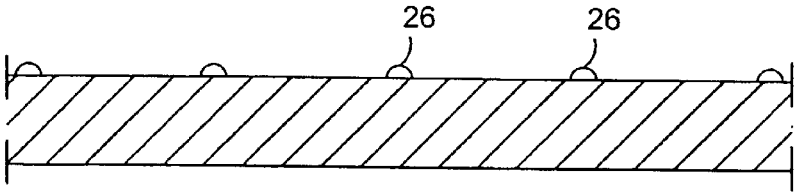
FIG. 7 is a cross-section along lines 7—7 in FIG. 5.

In accordance with a more simplified surface texture approach of the present invention, FIG. 5 illustrates the pattern of FIG. 2 without the diamond-cuts 22*a*, 22*b*, 22*c* and 22*d*. Moreover, in FIG. 5 the diamond-cuts 24*a*, 24*b*, 24*c* and 24*d* are more pronounced. By omitting the diamond-cuts 22*a*, 22*b*, 22*c* and 22*d* the texture is formed of generally square, or rectangular or rhombus shaped structures surrounded by the cuts 24*a*, 24*b*, 24*c* and 24*d*. The pattern illustrated in FIG. 5 still produces a sparkly brilliant surface texture and provides the locations for gemstones 26 and 28, wherein the gemstones 28 are located more deeply within the surface of the jewelry. The high points on the surface are defined at the locations of the gemstones 26, as illustrated in FIG. 5. In other respects, the features and functionality described above are equally applicable to the embodiment illustrated in FIG. 5.

More specifically with reference to FIG. 5, one can view the surface design as defining a plurality of apex points 31, 32, 33, 34, 35, 36, 37, 38 and 39, etc. which represent the points in the matrix that are at approximately the same distance from corresponding points, on the row and column lines of the matrix.

The diamond-cuts are so made that, from each set of points which together define a square (or rectangle or rhombus), a cut is made toward the center of that set, for example, the center 41 for the points 31, 32, 34 and 35, or cuts directed toward the center 42 of the set of the points 34, 35, 37 and 38, etc. The points 31–39 define the high points in the design and the points 41–44 define the low points in the design, owing to the fact that each cut made from each defined point 31–39 tapers in depth and width toward the centers 41–44, as described and illustrated previously relative to the cuts 24*a*, 24*b*, 24*c* and 24*d*. However, the cuts can be more pronounced, both in terms of their depth and their width as they taper toward the centers 41–44. As such, mesas or plateaus are defined that create the surface texture, which plateaus are surrounded by the diamond-cuts 24*b*, 24*d*, 24*e* and 24*f*. The heights of the walls surrounding each mesa are unequal owing to the fact that the mesa defined by the cuts 24*b*, 24*d*, 24*e* and 24*f* has a wall height which is taller at the corner 41, than at the corner 34, as should be apparent. This unevenness in wall height only adds to the sparkling effect due to the uneven reflection of light from the surface.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of texturing the surface of a jewelry piece made of metal to increase light reflectivity, the method comprising the steps of:

forming a series of grooves by a process of diamond-cutting the surface of the jewelry piece to divide the surface thereof into a plurality of adjacent, four-sided regions, each of which is bounded by four diamond-cut grooves and defines a mesa with at least four light-reflecting sloping sides; and further subdividing the four-sided mesas by forming a pair of diamond-cut grooves that criss-cross one another, so as to divide the mesas in the four-sided regions into four sub-mesas, each having at least three sloping light-reflecting sides.

2. The method of claim 1, in which the criss-cross, diamond-cut grooves are formed at right angles to one another.

3. The method of claim 1, in which the mesas are substantially pyramid-shaped.

4. The method of claim 1, further including setting first gemstones at junctures where the grooves defining the four-sided mesas meet.

5. The method of claim 4, wherein the first gemstones are formed of man-made material.

6. The method of claim 5, wherein the man-made material is enamel.

7. The method of claim 1, further including setting second gemstones at the center of the criss-crossed diamond-cut grooves.

8. The method of claim 7, wherein the second gemstones are made of enamel.

9. The method of claim 4, further including setting second gemstones at the center of the criss-crossed diamond-cut grooves.

10. The method of claim 9, wherein the second gemstones are made of enamel.

11. The method of claim 9, wherein the second gemstones are larger in size than the first gemstones.

12. The method of claim 7, wherein the second gemstones are made of transparent material.

13. The method of claim 1, wherein the surface texturing is formed on the surface of a jewelry ring.

14. The method of claim 13, wherein the surface texturing is formed on the surface of a jewelry earring.

15. A jewelry piece made of metal and with a textured surface, the textured surface comprising:

a series of grooves made by a process of diamond-cutting the surface of the jewelry piece to divide the surface thereof into a plurality of adjacent, four-sided regions, each of which is bounded by four diamond-cut grooves and defines a mesa with at least four light-reflecting sloping sides; and wherein each of the four-sided mesas are further subdivided by pair of diamond-cut grooves that criss-cross one another, so as to divide the mesa in each four-sided region into four sub-mesas, each having at least three sloping light-reflecting sides.

16. The jewelry piece of claim 15, in which the mesas are substantially pyramid-shaped.

17. The jewelry piece of claim 15, further including first gemstones set at junctures of the grooves.

18. The jewelry piece of claim 17, further including second gemstones set at the centers of the criss-cross diamond-cut grooves.

19. The jewelry piece of claim 18, wherein the first and second gemstones are made of man-made materials.

20. The jewelry piece of claim 15, wherein the jewelry piece is a jewelry earring.

21. A method of texturing the surface of a jewelry piece made of metal to increase the light reflectivity thereof, the method comprising the steps of:

defining a matrix of high-points on the surface, the matrix of high-points comprising a plurality of points arranged in rows and columns with the locations of the high-points being approximately equally spaced from one another; and effecting a series of diamond-cuts on the surface in such a manner that every set of four of the high-points defines the initial points of four diamond-cuts which proceed toward and meet at a center of an area on the surface that is circumscribed by the set of high-points so that a plurality of mesa structures are defined on the surface where every mesa has four corners, two of them defined by two of the high-points and two low-points that are defined by two of the centers.

22. The method of claim 21, including forming the diamond-cuts such that their width and depth into the material of the jewelry piece increases as the cut proceeds from the initial points to the centers.

* * * * *